US008006707B2

(12) United States Patent
Thorpe et al.

(10) Patent No.: US 8,006,707 B2
(45) Date of Patent: Aug. 30, 2011

(54) ROTATING DIAL SIFTER

(75) Inventors: Timothy Thorpe, Santa Monica, CA (US); Luis Alviar, Santa Monica, CA (US)

(73) Assignee: HCT Asia Ltd., Central (HK)

( * ) Notice: Subject to any disclaimer, the term of this patent is extended or adjusted under 35 U.S.C. 154(b) by 591 days.

(21) Appl. No.: 12/022,070

(22) Filed: Jan. 29, 2008

(65) Prior Publication Data

US 2009/0188518 A1 Jul. 30, 2009

(51) Int. Cl.
*A45D 33/02* (2006.01)
*A47J 43/22* (2006.01)

(52) U.S. Cl. ..... 132/307; 209/372

(58) Field of Classification Search ..... 132/306, 132/307; 222/182, 480, 548, 565; 209/372
See application file for complete search history.

(56) References Cited

U.S. PATENT DOCUMENTS

| | | | | |
|---|---|---|---|---|
| 1,156,456 | A | 10/1915 | Beck | |
| 1,274,697 | A | 8/1918 | Dynowsky | |
| 1,357,306 | A * | 11/1920 | Aste | 132/307 |
| 1,620,002 | A | 3/1927 | Barany | |
| 1,642,780 | A | 9/1927 | Kole et al. | |
| 1,668,658 | A | 5/1928 | Reutter | |
| 2,817,451 | A | 12/1957 | Giles | |
| 3,100,589 | A | 8/1963 | Love | |
| 3,276,642 | A | 10/1966 | Johnson | |
| 4,626,119 | A | 12/1986 | Ladd, Jr. | |
| 4,630,954 | A | 12/1986 | Ladd, Jr. | |
| 4,630,955 | A | 12/1986 | Ladd, Jr. et al. | |
| 4,647,240 | A | 3/1987 | Ladd, Jr. et al. | |
| 4,652,162 | A | 3/1987 | Ladd, Jr. et al. | |
| 4,671,690 | A | 6/1987 | Ladd, Jr. et al. | |
| 4,728,211 | A | 3/1988 | Ladd, Jr. | |
| 4,888,668 | A | 12/1989 | Roll | |
| 5,515,876 | A | 5/1996 | Warner et al. | |
| 5,975,368 | A * | 11/1999 | Wood | 222/151 |
| 6,053,183 | A | 4/2000 | Rizzo | |
| 6,929,159 | B1 | 8/2005 | Haig | |
| 7,494,030 | B2 * | 2/2009 | Bennett | 222/480 |
| 2006/0278665 | A1 | 12/2006 | Bennett | |
| 2007/0205233 | A1 | 9/2007 | Petit et al. | |

FOREIGN PATENT DOCUMENTS

| | | |
|---|---|---|
| FR | 2911766 | 8/2008 |
| GB | 2446039 | 7/2008 |

OTHER PUBLICATIONS

FR Search Report (and English translation) mailed on Mar. 30, 2011 for French Patent Application No. 0853647.

* cited by examiner

*Primary Examiner* — Rachel R Steitz
(74) *Attorney, Agent, or Firm* — Lee & Hayes, PLLC

(57) ABSTRACT

Described herein are containers having a bottom portion, a bottom sifter, a dial sifter, and a removable cover having pins. A bottom sifter and a dial sifter are rotatably engaged, and both have at least one sifting hole for sifting materials with a powder-like consistency. Either the surface of the bottom sifter facing the dial sifter or the surface of the dial sifter facing the bottom sifter may have at least one raised portion, and the remaining surface may have at least one recessed depression. The dial sifter may have one or more cavities to engage the pins in the cover, thereby rotating the dial with the rotation of the cover.

15 Claims, 11 Drawing Sheets

ROTATING DIAL SIFTER

BACKGROUND

Cosmetic materials such as those used for cosmetic foundation are typically provided as a compacted or a loose powder. Loose materials, including loose powder, are becoming more common due in part to the fact that loose material provides improved coverage of the material on a surface. The loose material may be provided in a container with a perforated surface or sifter so that the powder is shaken out of the perforations and the powder can be applied onto an applicator. This configuration is problematic in that the loose material has a tendency to move up through the perforations during handling and/or jostling of the container, such as the movements associated with carrying the container in a handbag, pocket, or purse. The loose material may deposit above the perforated surface and/or on the cap and may at least partially spill out when the container is opened.

SUMMARY

This disclosure relates to containers usable for holding and dispensing, among other things, powdered or powder-like cosmetics products. According to one exemplary implementation, a container is disclosed that has a bottom portion, a bottom sifter, a dial sifter and a removable cover having pins. The cover has a radially extending top portion, and an axially extending side wall portion. The bottom sifter is engaged with the bottom portion and has at least one sifting hole for sifting materials with a powder-like consistency. The dial sifter is rotatably engaged with the bottom sifter and has at least one sifting hole to align with the at least one sifting hole in the bottom sifter. In an implementation, either the surface of the bottom sifter facing the dial sifter or the surface of the dial sifter facing the bottom sifter has at least one raised portion, and the remaining surface has at least one recessed depression. In other implementations, neither surface of the dial sifter, or the bottom sifter, or both sifters may have a raised portion or a recessed depression. When present, the raised portion and the recessed depression operate to inhibit the dial sifter from rotating relative to the bottom sifter, and to align the sifting holes in the dial sifter and the bottom sifter when the container is open. The upper surface of the dial has one or more axially extending cavities to align and engage axially protruding pins in the cover. When the cover is rotated, the axially protruding pins extend into the axially extending cavities on the dial surface. The dial may rotate with the rotation of the cover, such that when the cover is rotated into a closed position the dial is rotated in relation to the bottom sifter to offset the holes in the bottom sifter and the holes in the dial. When the cover is rotated into an open position the dial is rotated in relation to the bottom sifter to align the holes in the bottom sifter with the holes in the dial.

According to another exemplary implementation, a container is disclosed that is configured to be filled from the bottom of the container. This implementation includes a container having a top portion, an open bottom portion, a rotating sifter mechanism engaged with the top portion, a cover for enclosing the top portion, and a bottom cap for enclosing the open bottom portion. The rotating sifter mechanism includes a bottom sifter and a dial sifter, the dial sifter being engaged with the cover. Material may be supplied to the open bottom portion. The bottom cap is then affixed to the open bottom portion to enclose the material within the container.

DETAILED DESCRIPTION

Figure 1:
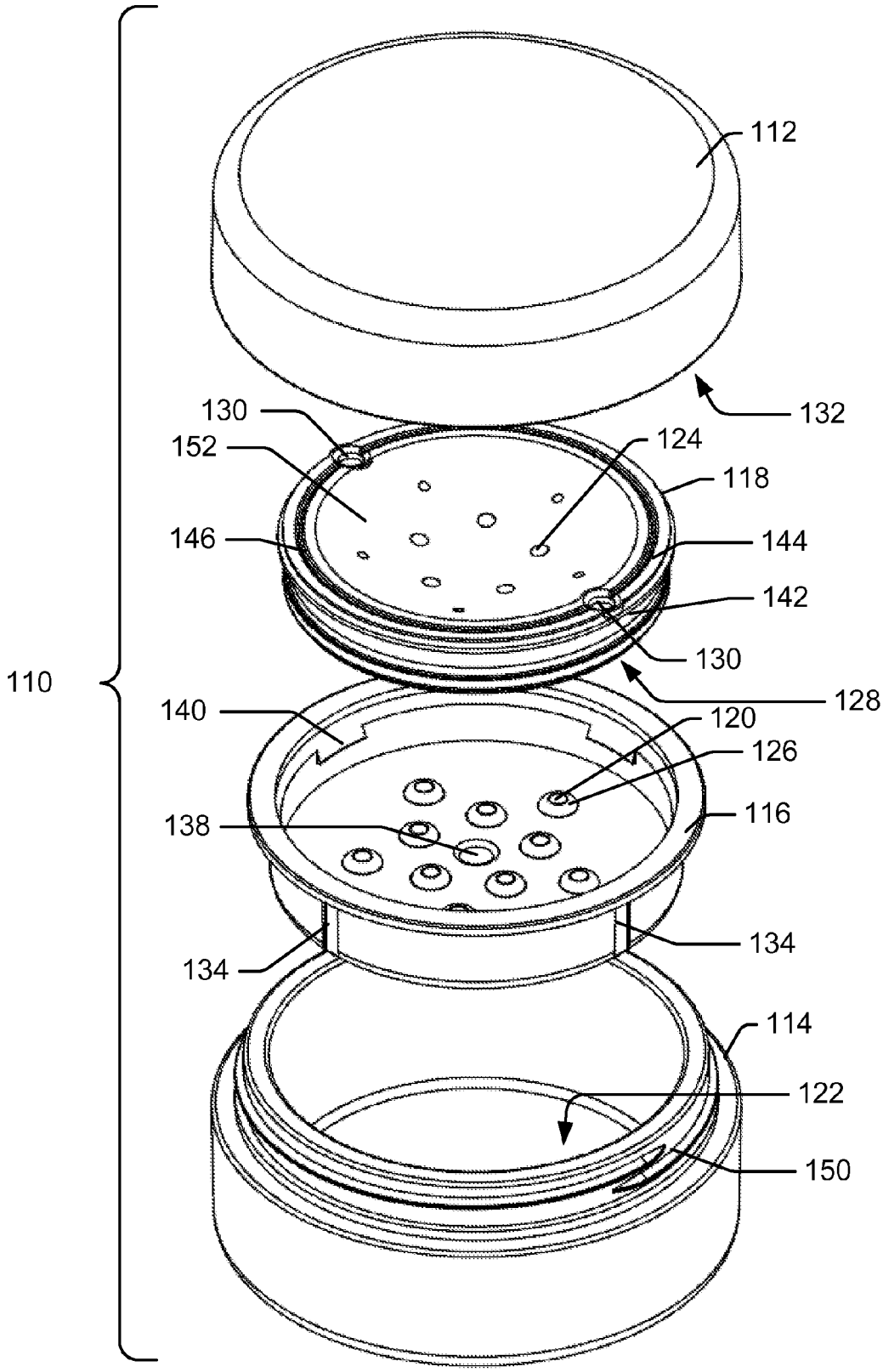
FIG. 1 shows an exploded view of a container having a rotating dial sifter, according to one exemplary implementation.
Figure 2:
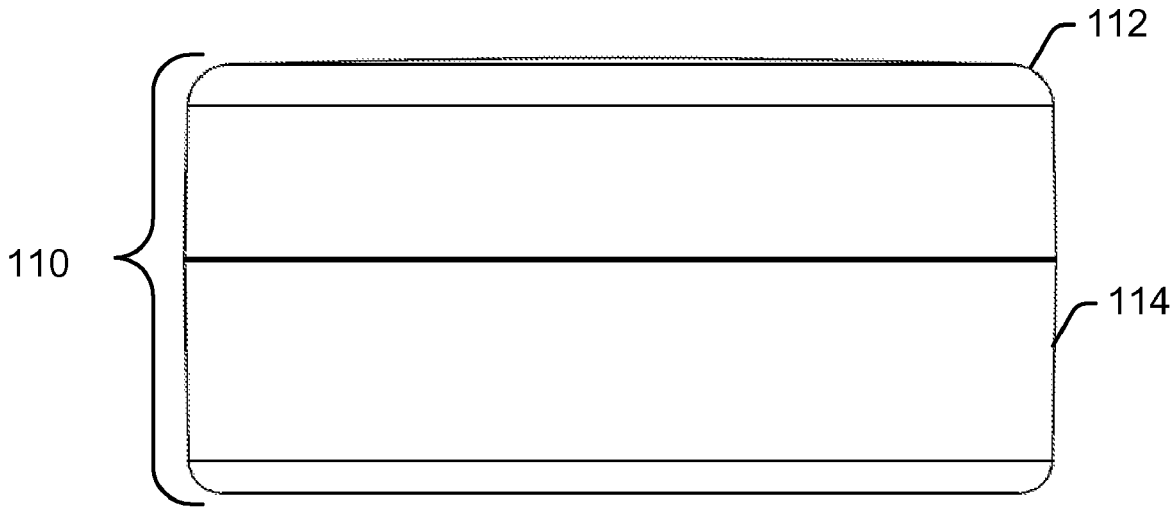
FIG. 2 shows an elevational view of the container of FIG. 1.
Figure 3:
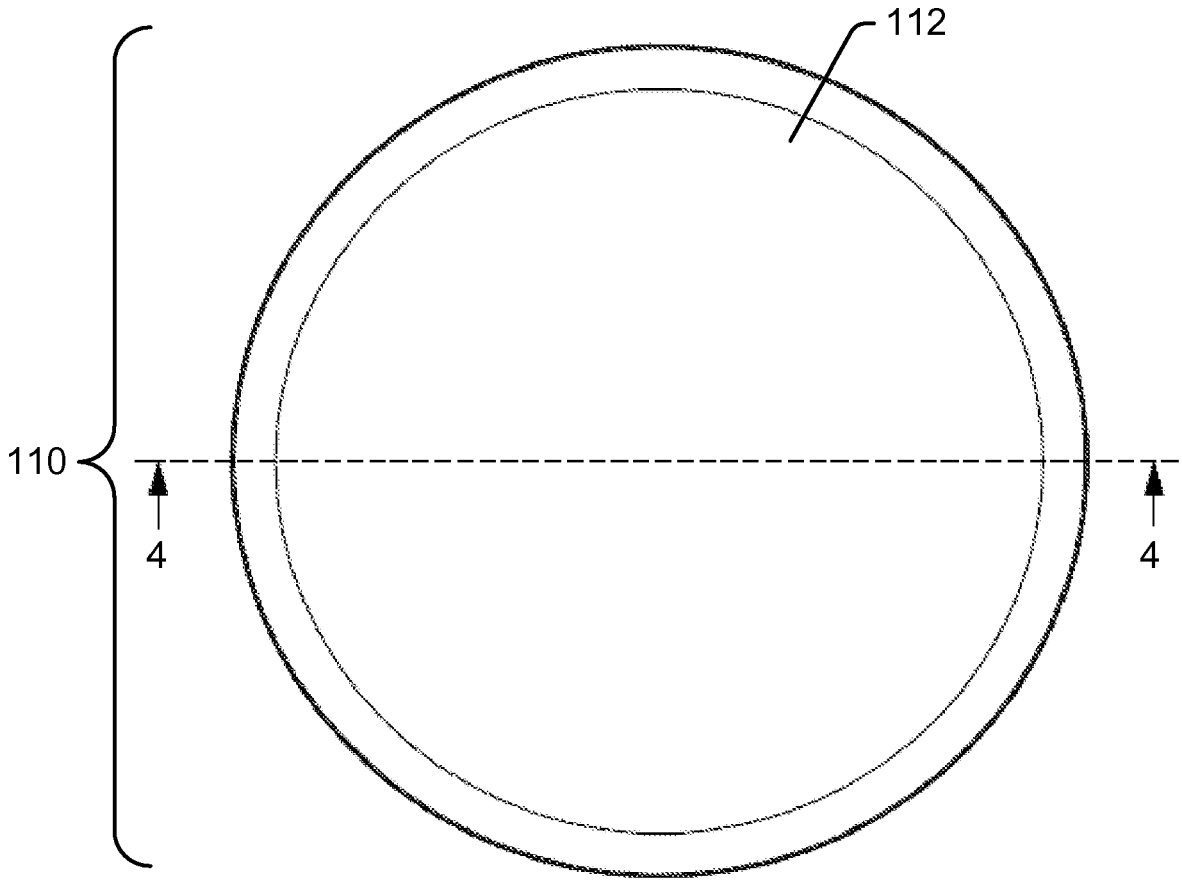
FIG. 3 shows a top plan view of the container of FIG. 1.

Containers having rotating sifter mechanisms will now be described with reference to the figures. While the disclosure is described in the context of sifters for powdered cosmetics products, they may be useful for other powdered or powder-like products, such as baby powder, foot powder, medicinal powders, and the like.

FIGS. 1-6 show a container 110 including a cover 112 and a bottom portion 114. As shown in the exemplary implementation shown in FIG. 1, the container 110 is provided with a bottom sifter 116 engaged with the bottom portion 114. A dial sifter 118 is engaged with the bottom sifter 116. The bottom sifter 116 has at least one hole 120 for sifting loose material, such as facial powder, makeup, or the like stored within a cavity 122 in the bottom portion 114. The dial sifter 118 has at least one hole 124, which is capable of aligning with the holes 120 in the bottom sifter 116. Thus, a user may access the powder by at least slightly inverting the container 110 to sift the loose material through the holes 120 and 124 when they are aligned.

In this exemplary implementation, the surface of the bottom sifter 116 facing the dial sifter 118 has at least one raised portion 126, which may be a co-molded thermoplastic elastomer (TPE), centrally aligned with each of the at least one sifting hole 120 in the bottom sifter 116. The surface of the dial sifter 118 facing the bottom sifter 116 has at least one recessed depression 128 centrally aligned with each of the at least one hole 124 in the dial sifter 118. The at least one raised portion 126 on the bottom sifter 116 is capable of engaging the at least one recessed depression 128 in the dial sifter 118, thus aligning and maintaining alignment of the at least one hole 120 in the bottom sifter 116 with the at least one hole 124 in the dial sifter 118 while in an open position. Alternatively, the at least one raised portion 126 on the bottom sifter 116 is capable of engaging the at least one recessed depression 128 in the dial sifter 118, thus offsetting and maintaining offset of the at least one hole 120 in the bottom sifter 116 with the at least one hole 124 in the dial sifter 118 while in a closed position. The tension associated with the engagement of the at least one raised portion 126 with the at least one recessed depression 128 is overcome by a predetermined force in order to release the engagement of the at least one raised portion 126 with the at least one recessed depression 128, to rotate or change the position of the dial sifter 118 relative to the bottom sifter 116 during opening or closing of the container 110. The engagement may reduce inadvertent alignment or misalignment of the dial sifter 118 and the bottom sifter 116 caused by, for example, incidental force or contact.

The implementation described above is exemplary only and is not intended to be limiting. For example, the at least one raised portion 126 may be provided on the dial sifter 118 and the at least one recessed depression 128 may be provided on the bottom sifter 116. In another alternative implementation, the at least one raised portion 126 may be aligned in an offset or eccentric manner relative to the at least one sifting hole in the sifter, or with respect to the surface of the sifter. Additionally, the at least one raised portion 126 may have any shape such as a teardrop shape, an offset oval, or the like. In such an instance, the alignment and shape of the at least one recessed depression on one sifter may correspond to the alignment and shape eccentricities of the corresponding at least one raised portion on the other sifter, resulting in secure engagement of the sifters. Further, the at least one recessed depression may have a hollow cylindrical form, allowing it to securely engage with multiple possible shapes of raised portions on the opposite sifter. Moreover, the recessed depression may be provided at the end of a pedestal 129 extending axially away from the surface of the dial sifter 118. This creates a flush contact between the dial sifter 118 and the bottom sifter 116 even if the two sifters have different surface contours. In alternate implementations, neither surface of the dial sifter 118, or the bottom sifter 116, nor both sifters may have a raised portion 126 or a recessed depression 128.

The container 110 is provided with a mechanism to rotate the dial sifter 118 in relation to the bottom sifter 116 so that the sifting holes 120 and 124 are aligned when the container 110 is "open" to allow a user to access the powder. When the container 110 is "closed," the sifting holes 120 and 124 are rotated out of alignment, which prevents powder from traveling from the bottom portion 114 through the bottom sifter 116 and the dial sifter 118. In order to rotate the dial sifter 118 while opening or closing the container 110, the dial sifter 118 has at least one axially extending cavity 130 in the surface facing away from the bottom portion 114. The cover 112 has at least one axially protruding pin 132, shown in FIG. 6, which extends into the at least one cavity 130 on the surface of the dial sifter 118. The at least one pin 132 extends into the at least one cavity 130 during a rotation of the cover 112 to close the container. The at least one pin 132 engages with the at least one cavity 130, thus rotating the dial sifter 118 with the rotation of the cover 112.

The bottom sifter 116 is secured or fixed to the bottom portion 114 by friction, glue, threaded engagement, or other suitable means. As shown in FIG. 1, ribs 134 or other contoured features may additionally provide a surface for maintaining the bottom sifter 116 in the bottom portion 114. The bottom sifter 116 is positioned to retain loose material within cavity 122.

Figure 4:
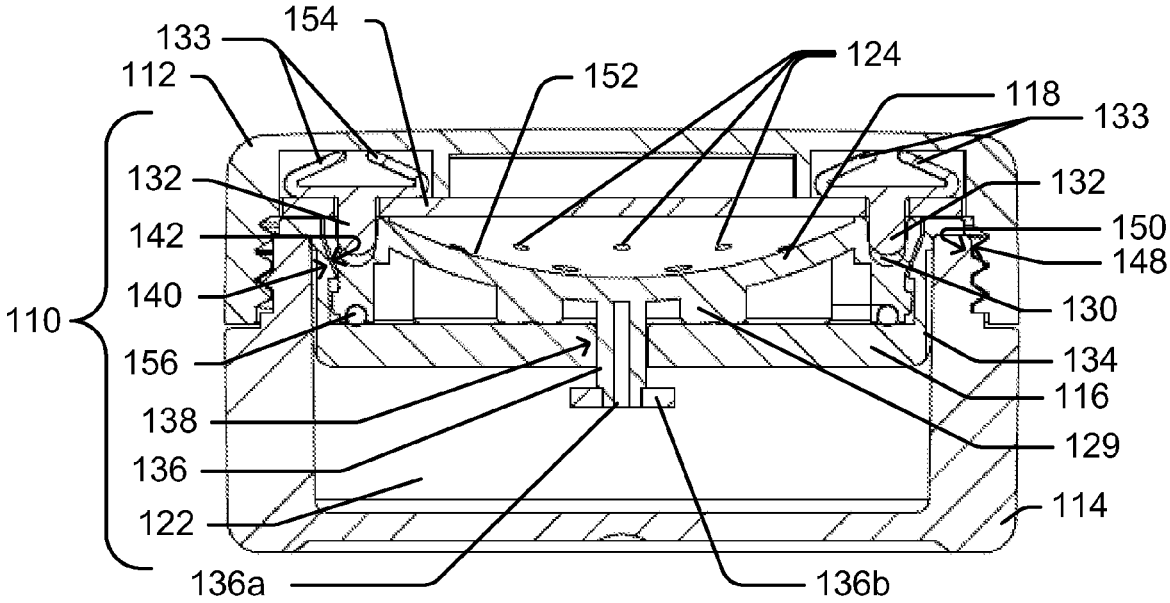
FIG. 4 shows a cross-sectional view of the container of FIG. 1, taken along line 4-4 in FIG. 3.

The dial sifter 118 is secured to the bottom sifter 116 by friction or other suitable means. The dial sifter 118 may additionally be secured to the bottom sifter 116 by a pin 136 protruding from the center of the surface of the dial sifter 118 facing the bottom sifter 116. The pin 136 extends through a hole 138 in the center of the bottom sifter 116, as shown in FIG. 4. The pin 136 may be have a hollow center **136*a* for convenience of manufacturing, and may have a flange, or a cap 136*b* located and/or affixed to the end of the pin 136 to secure the dial sifter 118 in place. Additionally or alternatively, one or more ribs 140 on the bottom sifter 116 may be configured to engage with one or more grooves 142 in the dial sifter 118. The groove 142 shown in FIG. 1 is a circular groove, gap, slot, or the like along the outer circumference of the dial sifter 118**.

The dial sifter 118 has a rim portion 144 that extends around the upper surface of the dial sifter 118. At least one axial cavity 130 is positioned along the rim portion 144. Additionally, there is a guide channel 146 positioned along the surface of the rim portion 144, concentric to the circumference of the dial sifter 118. The guide channel 146 intersects the at least one cavity 130. The at least one pin 132, which may be a polypropylene material, is configured to be axially protruding from the cover 112 to extend into the guide channel 146 when the cover 112 is positioned. During rotation of the cover 112, the at least one pin 132 is guided along the guide channel 146 and may be in a spring-compression state caused by the deflection of the at least one pin 132 toward the cover 112 and one or more spring members 133 toward the pin 132. In the spring-compression state, the at least one pin 132 may experience a higher level of compression than when the cover 112 is not engaged with the dial sifter 118. Further rotation of the cover 112 allows the at least one pin 132 to encounter and engage the at least one cavity 130, thus releasing at least a portion of the spring compression on the at least one pin 132, extending it into the at least one cavity 130, and rotatably securing the cover 112 directly to the dial sifter 118. Rotation of the cover 112 thus rotates the dial sifter 118. Additionally, the cover 112 has a threaded portion 148, shown in FIG. 6, which engages with a threaded portion 150 on the bottom portion 114 of the container 110.

In an exemplary implementation, the dial sifter 118 has a hollow, sloped, or concave surface 152 on the side of the dial sifter 118 facing away from the bottom sifter 116, i.e., the surface facing upward from the bottom portion 114. This surface 152 assists in directing powder or other material into the at least one hole 124 and, thus, into the loose material holding cavity 122. This hollowed or sloped surface 152 reduces the amount of powder or other material above the dial sifter 118 when the container 110 is held in an upright position, such as when a user is preparing to close the container 110. Reducing the amount of powder above the dial sifter 118 and maintaining the holes 120 and 124 in an offset configuration while the cover is closed reduces the amount of powder that may be spilled while the container 110 is closed or when the container 110 is initially opened. In other implementations, the dial sifter 118 does not have a hollow, sloped, or concave surface 152 on either side.

The cover 112 has a sealing layer 154 engaged with the cover 112 for pressing or touching the dial sifter 118 to further prevent the unintentional spillage of powder from the container 110. Additionally, there may be a ring-shaped gasket 156 between the dial sifter and the bottom sifter to prevent material from leaking around the sifters.

Figure 5:
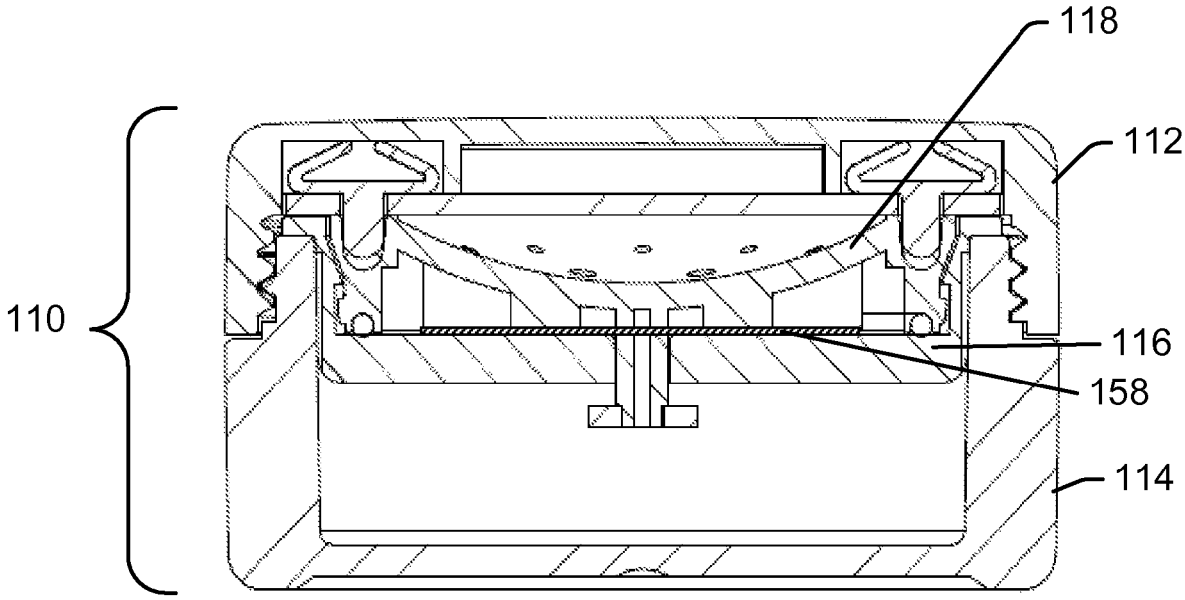
FIG. 5 shows a cross-sectional view of the container of FIG. 1, taken along line 4-4 in FIG. 3 and in which an elastomer layer is sandwiched between the bottom sifter and dial.
Figure 6:
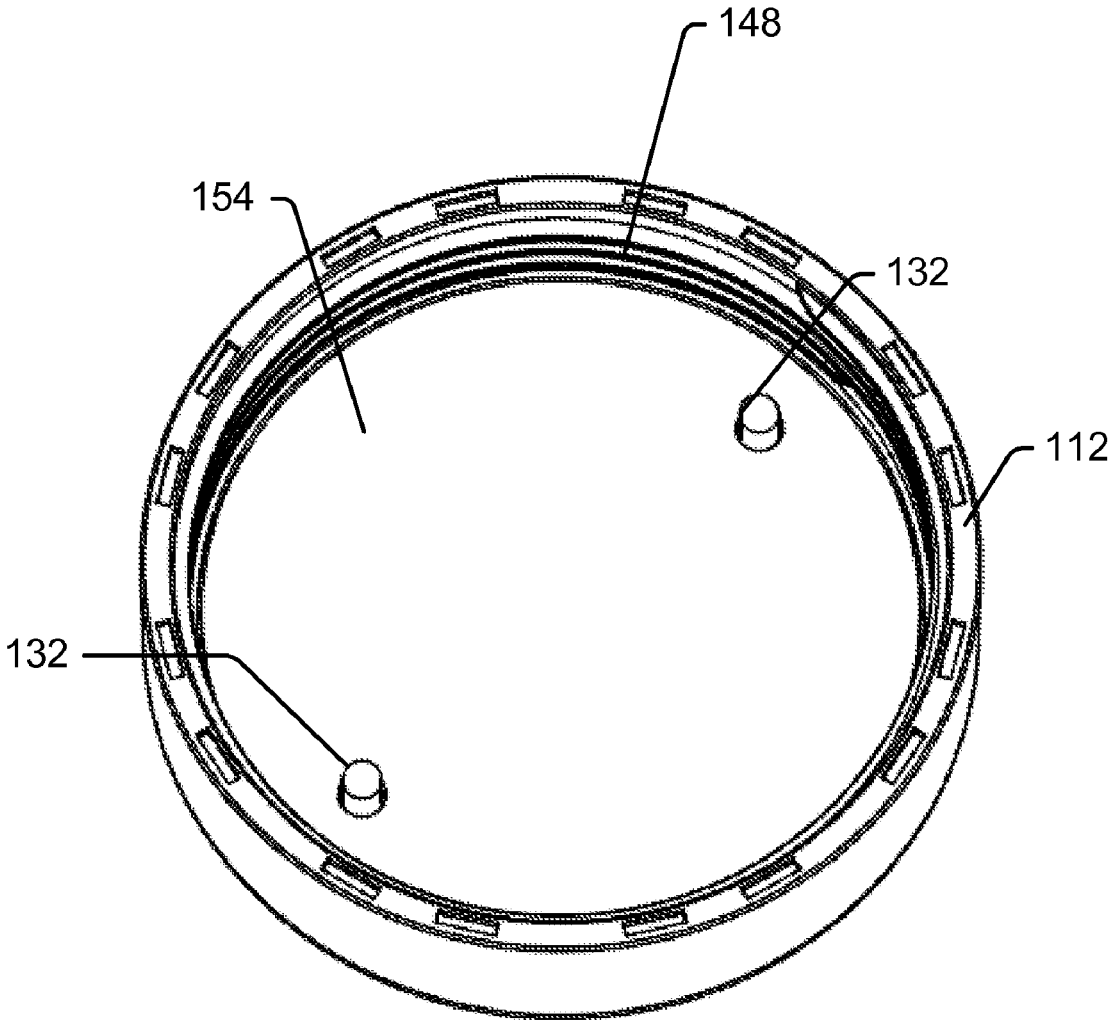
FIG. 6 shows a perspective view of the underside of the cover for the rotating sifter of FIG. 1.

As shown in FIG. 5, the dial sifter 118 may be provided with an elastomeric layer 158, which may be a co-molded thermoplastic elastomer (TPE). The elastomeric layer 158 is formed on the side of the dial sifter 118 facing the bottom sifter 116 and may deform and seal any gap between the bottom sifter 116 and the dial sifter 118, particularly in the vicinity of the holes 120 and 124. The elastomeric layer 158 may alternatively be provided on the bottom sifter 118 on the side facing the dial sifter 118.

The bottom portion 114, bottom sifter 116, dial sifter 118, and cover 112 may be constructed of polypropylene, polyethylene, other plastic, glass, wood, or other suitable material and may be molded or formed according to conventional methods. The sealing layer 154 may be waxed paperboard, Teflon, or other suitable material.

Figure 7:
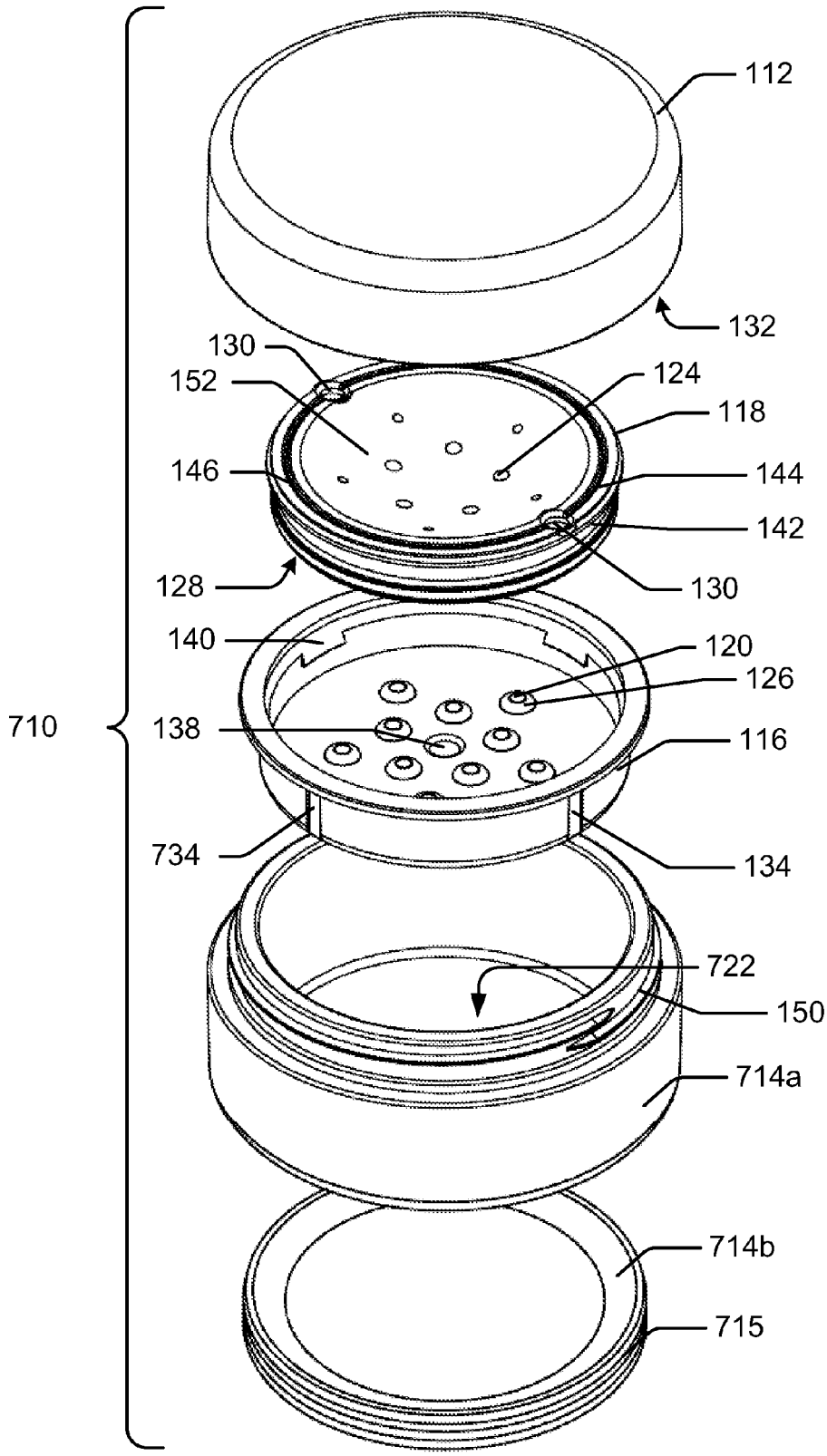
FIG. 7 is an exploded view of a container according to another exemplary implementation, having a rotating sifter mechanism including a bottom sifter and a dial, and a bottom cap for enclosing the bottom portion of the container.
Figure 8:
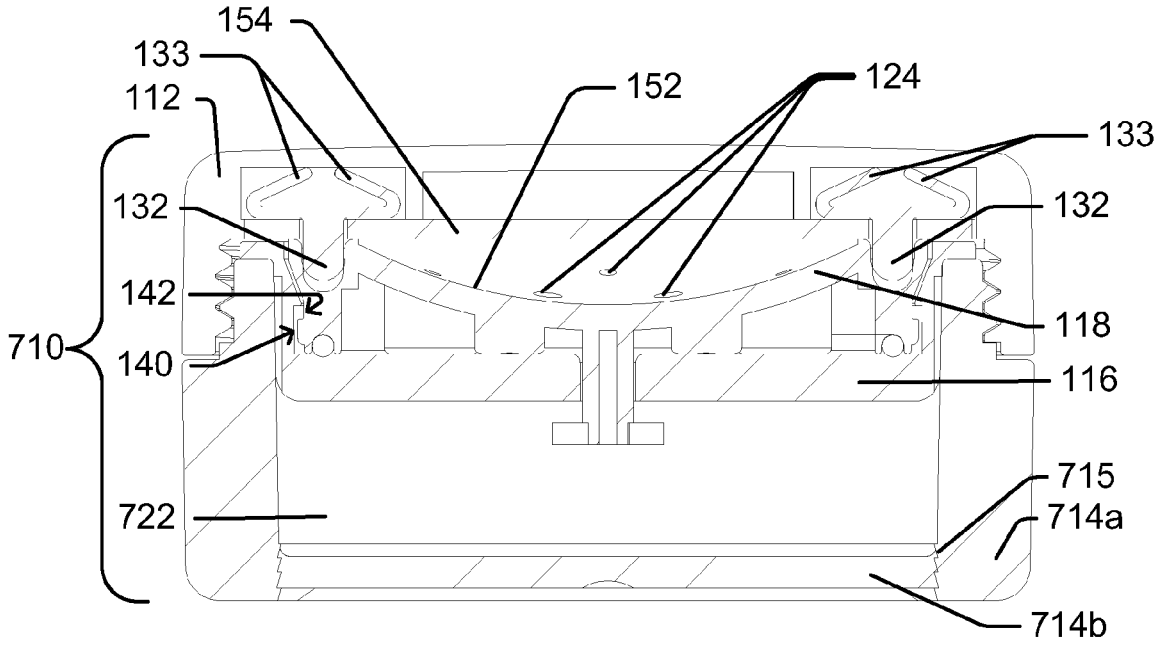
FIG. 8 shows a cross-sectional view of the container of FIG. 7.

FIGS. 7 and 8 show a variation of the container shown in FIGS. 1-6, in which the bottom portion has a bottom cap. More particularly, the container 710 has a bottom portion 714 which includes a container wall portion 714*a* and a bottom cap 714*b*. The bottom cap 714*b* allows a user to load powder into the loose material holding cavity 722 of the container after assembling the container 710. This is accomplished by a process of inverting the assembled container 710, filling the bottom portion 714 with powder, and affixing the bottom cap 714*b*. The bottom cap 714*b* is secured to the bottom wall portion 714*a* by friction, glue, threaded engagement, and/or other suitable engagement means. Ribs 715 may assist in maintaining engagement of the bottom cap 714*b* with bottom wall portion 714*a*.

Figure 9:
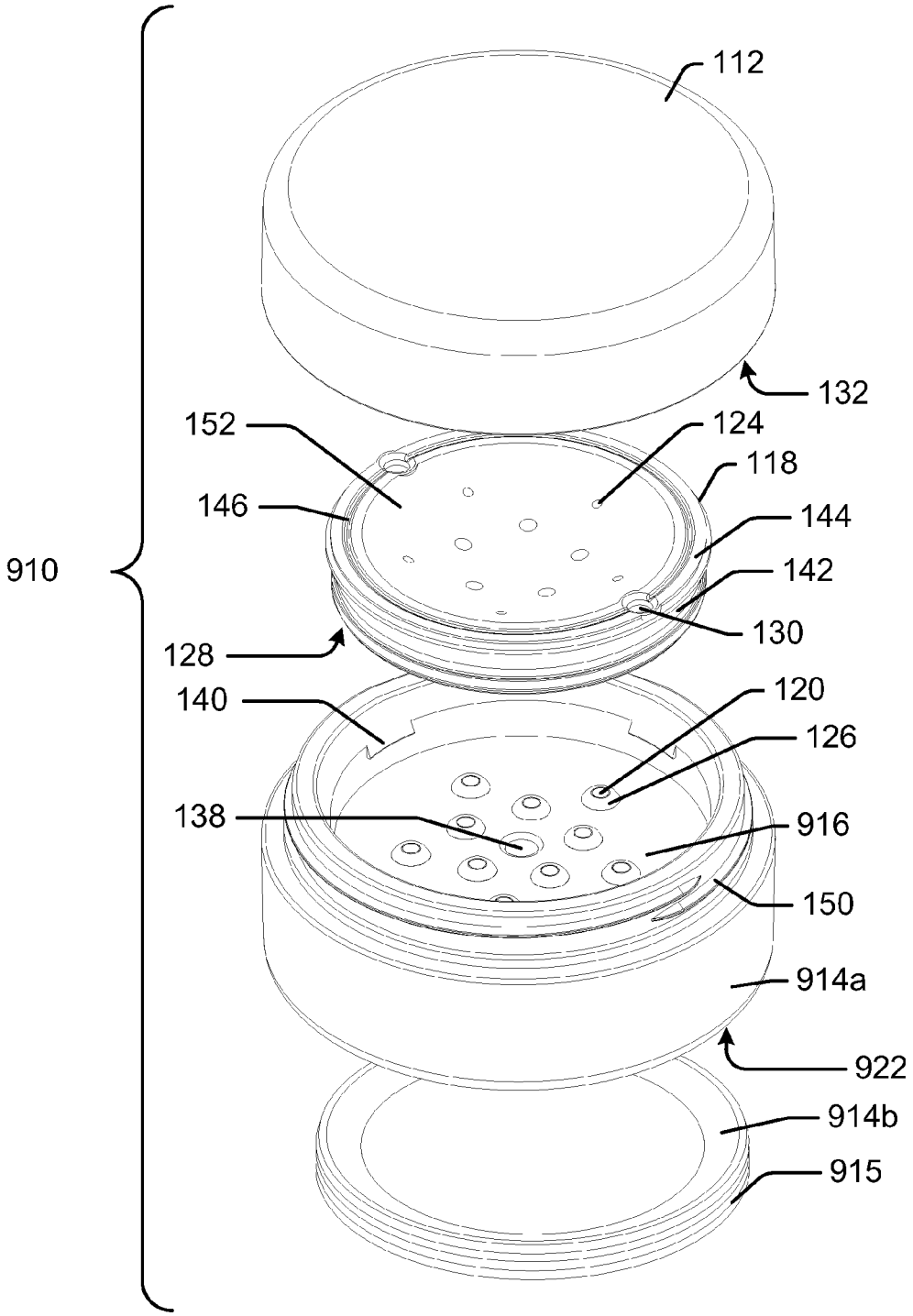
FIG. 9 is an exploded view of a container according to another exemplary implementation, having a rotating sifter mechanism including a bottom sifter and a dial, the bottom sifter being integral with a bottom portion of the container, and a bottom cap for enclosing the bottom portion of the container.
Figure 10:
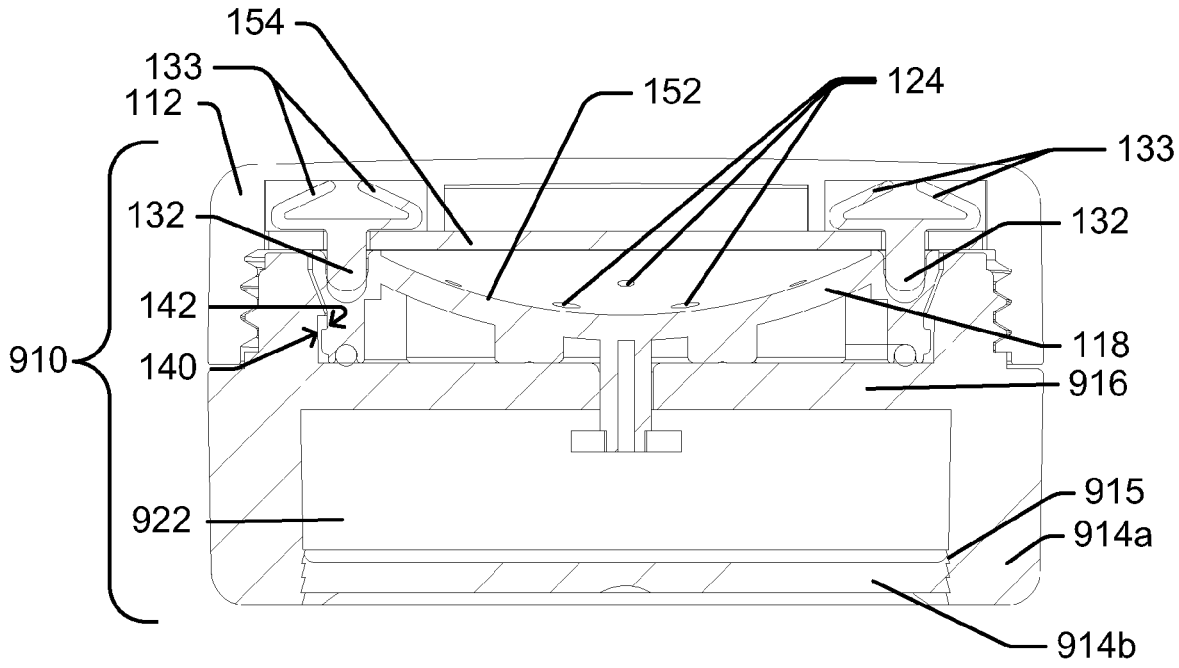
FIG. 10 shows a cross-sectional view of the container of FIG. 9.

FIGS. 9 and 10 show a variation of the container shown in FIGS. 7-8, in which the sifter and bottom portion are integral and the bottom portion has a bottom cap. More particularly, the container 910 has a bottom portion 914 which includes a container wall portion 914*a*, an integral sifter 916, and a bottom cap 914*b*. The bottom cap 914*b* allows a user to load powder into the loose material holding area 922 of the container after assembling the container 910. This is accomplished by a process of inverting the assembled container 910, filling the bottom portion 914 with powder, and affixing the bottom cap 914*b*. The bottom cap 914*b* is secured to the bottom wall portion 914*a* by friction, glue, threaded engagement, and/or other suitable engagement means. Ribs 915 may assist in maintaining engagement of the bottom cap 914*b* with bottom wall portion 914*a*.

Figure 11:
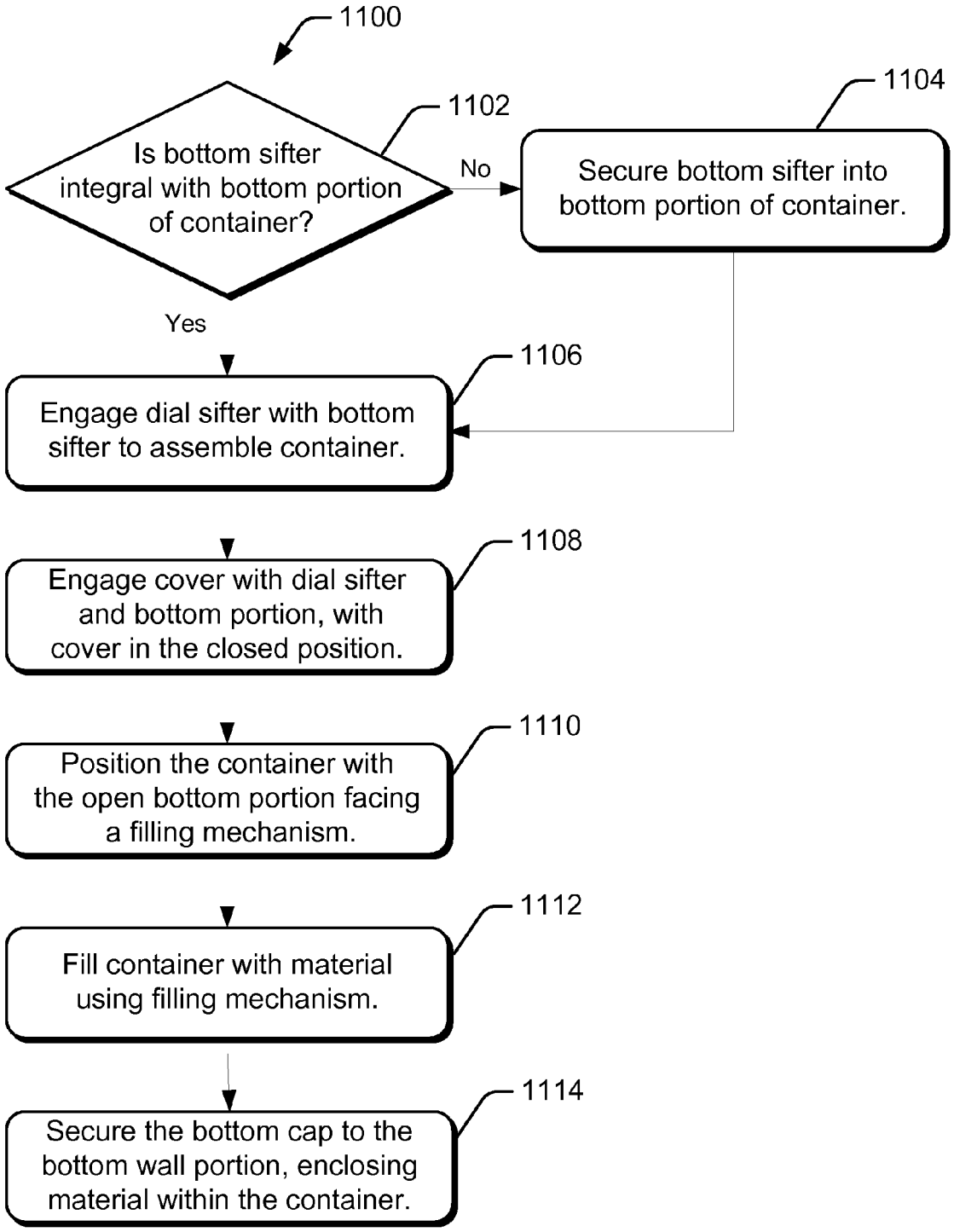
FIG. 11 is a flow diagram showing an exemplary process to fill a container with powder via an opening in the bottom of the container. The order in which the method is described is not intended to be construed as a limitation, and any number of the described method blocks may be combined in any order to implement the method, or an alternate method.

FIG. 11 shows an exemplary process 1100 for filling a container with powder via an opening in the bottom of the container. The order in which the method is described is not intended to be construed as a limitation, and any number of the described method blocks may be combined in any order to implement the method, or an alternate method. At 1102, the user determines whether the bottom sifter is configured as a distinct component. If the bottom sifter is determined to be a distinct component, rather than integral to the bottom portion of the container, then the distinct bottom sifter is secured to the bottom portion of the container at 1104. At 1106, the container is assembled by engaging the dial sifter with the bottom sifter. At 1108, the cover is engaged with the dial sifter and the bottom portion, with the cover placed in the closed position. At 1110, the user positions the container so that the open bottom portion faces toward a filling mechanism. The filling mechanism supplies material, such as facial powder, to the open bottom portion at 1112. At 1114, the bottom cap is secured to the bottom wall portion to enclose the material within the container.

Although details of specific implementations and embodiments are described above, such details are intended to satisfy statutory disclosure obligations rather than to limit the scope of the following claims. Thus, the claims are not limited to the specific features described above.

What is claimed is:

1. An apparatus comprising:

a bottom portion;

a bottom sifter engaged with the bottom portion and having at least one sifting hole;

a dial sifter rotatably engaged with the bottom sifter and having at least one sifting hole and at least one axially extending cavity; and a removable cover having at least one axially protruding pin to extend into the axially extending cavity in the dial sifter, the at least one axially protruding pin being in a spring-compressed state to facilitate engagement of the cover with the dial sifter and the dial sifter having a channel to guide travel of the at least one pin protruding from the cover along a surface of the dial sifter, wherein the pin is configured to engage with the dial sifter so that:

when the cover is rotated into a closed position the dial sifter is rotated in relation to the bottom sifter to offset the at least one sifting hole in the bottom sifter and the at least one sifting hole in the dial sifter, and when the cover is rotated into an open position the dial sifter is rotated in relation to the bottom sifter to align the at least one sifting hole in the bottom sifter with the at least one sifting hole in the dial sifter.

2. An apparatus according to claim 1, wherein the bottom sifter has a surface facing the dial sifter and the dial sifter has a surface facing the bottom sifter and the surface of the dial sifter facing the bottom sifter has at least one recessed depression, and the surface of the bottom sifter facing the dial sifter has at least one raised portion configured to engaged the recessed depression in the surface of the dial sifter.

3. An apparatus according to claim 2, wherein the at least one raised portion and the at least one recessed depression operate to couple the dial sifter with the bottom sifter so that the at least one hole in the bottom sifter is aligned with the at least one hole in the dial sifter.

4. An apparatus according to claim 2, wherein the at least one raised portion is aligned with the at least one sifter hole in the bottom sifter, and the at least one recessed depression is aligned with the at least one sifter hole in the dial sifter.

5. An apparatus according to claim 2, wherein the at least one raised portion material is a co-molded thermoplastic elastomer.

6. An apparatus according to claim 2, wherein the at least one recessed depression is provided at the end of a pedestal extending axially away from the surface of the dial sifter.

7. An apparatus according to claim 1, wherein the at least one pin is constructed of a material comprising a polypropylene material.

8. An apparatus according to claim 1, wherein a pin protruding from the underside of the dial sifter extends through a hole in the center of the bottom sifter to secure the dial sifter to the bottom sifter.

9. An apparatus according to claim 1, wherein the dial sifter is provided with an elastomeric material on at least a portion of the surface of the dial sifter facing the bottom sifter, the elastomeric material to seal a gap between the bottom sifter and the dial sifter in the vicinity of the sifting holes in the bottom sifter and the dial sifter.

10. An apparatus according to claim 9, wherein the elastomeric material is a co-molded thermoplastic elastomer.

11. An apparatus according to claim 1, further comprising a ring-shaped gasket between the dial sifter and the bottom sifter to prevent material leaking around the sifters.

12. An apparatus according to claim 1, wherein the bottom portion is comprised of a bottom cap engaged with a bottom wall portion.

13. An apparatus according to claim 12, wherein the bottom sifter and bottom portion are integral.

14. An apparatus according to claim 1, wherein the dial sifter has a concave surface on the side of the dial sifter opposite the bottom sifter, the concave surface to direct loose material to the sifting holes in the dial sifter and bottom sifter.

15. An apparatus according to claim 1, wherein:

either a surface of the bottom sifter facing the dial sifter or a surface of the dial sifter facing the bottom sifter has at least one raised portion, and the remaining surface has at least one recessed depression, the raised portion and the recessed depression operating to prevent the dial sifter from rotating with respect to the bottom sifter until a predetermined threshold force is applied; where:

the at least one raised portion and the at least one recessed depression operate to couple the dial sifter with the bottom sifter so that the at least one sifting hole in the bottom sifter is aligned with the at least one sifting hole in the dial sifter, and the at least one raised portion is aligned with the at least one sifter hole in the bottom sifter, and the at least one recessed depression is aligned with the at least one sifter hole in the dial sifter;

the at least one raised portion is a co-molded thermoplastic elastomer material;

the at least one recessed depression is provided at the end of a pedestal extending axially away from the surface of the dial sifter; and the at least one axially protruding pin is a polypropylene material;

a pin protruding from an underside of the dial sifter extends through a hole in a center of the bottom sifter to secure the dial sifter to the bottom sifter;

the dial sifter is provided with a co-molded thermoplastic elastomer material on at least a portion of the surface of the dial sifter facing the bottom sifter, the co-molded thermoplastic elastomer material for sealing a gap between the bottom sifter and the dial sifter in the vicinity of the sifting holes in the sifters;

a ring-shaped gasket is provided between the dial sifter and the bottom sifter to prevent material leaking around the sifters;

a bottom cap is engaged with the bottom portion; where:

the bottom sifter and bottom portion are integral; and the dial sifter has a concave surface on a side of the dial sifter opposite the bottom sifter, the concave surface to direct loose material to the sifting holes in the dial sifter and bottom sifter.

* * * * *